US008620648B2

(12) United States Patent
Morii

(10) Patent No.: US 8,620,648 B2
(45) Date of Patent: Dec. 31, 2013

(54) AUDIO ENCODING DEVICE AND AUDIO ENCODING METHOD

(75) Inventor: Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 540 days.

(21) Appl. No.: 12/670,777

(22) PCT Filed: Jul. 25, 2008

(86) PCT No.: PCT/JP2008/001999

§ 371 (c)(1),
(2), (4) Date: Jan. 26, 2010

(87) PCT Pub. No.: WO2009/016816

PCT Pub. Date: Feb. 5, 2009

(65) Prior Publication Data

US 2010/0191526 A1 Jul. 29, 2010

(30) Foreign Application Priority Data

Jul. 27, 2007 (JP) ..... 2007-196782
Oct. 3, 2007 (JP) ..... 2007-260426
Jan. 16, 2008 (JP) ..... 2008-007418

(51) Int. Cl.
*G10L 19/00* (2013.01)

(52) U.S. Cl.
USPC ..... 704/216; 704/200; 704/219; 704/500

(58) Field of Classification Search
USPC ..... 704/200–230, 500–504
See application file for complete search history.

(56) References Cited

U.S. PATENT DOCUMENTS

2001/0010038 A1* 7/2001 Kang et al. ..... 704/222
2001/0053972 A1 12/2001 Amada et al.
2004/0098254 A1* 5/2004 Lee et al. ..... 704/216
2005/0163323 A1 7/2005 Oshikiri (Continued)

FOREIGN PATENT DOCUMENTS

CN 1766988 5/2006
EP 1 677 287 7/2006

(Continued)

OTHER PUBLICATIONS

International Search Report dated Oct. 28, 2008.

(Continued)

*Primary Examiner* — Douglas Godbold
(74) *Attorney, Agent, or Firm* — Dickinson Wright PLLC

(57) ABSTRACT

An audio encoding device which can improve encoding performance while performing division search on an algebraic codebook in an audio encoding. In a distortion minimizing unit (112) of a CELP encoding device: a maximum correlation value calculation unit (221) calculates a correlation value by using each pulse and a target signal in each candidate position for four pulses constituting the fixed codebook so as to acquire a maximum value of the correlation value for each pulse and calculates a maximum correlation value by using the maximum value of the correlation value; a sorting unit (222) divides the four pulses into two subsets each having two pulses; and a search unit (224) performs a division search on the fixed codebook and acquires a code indicating the positions and polarities of the four pulses where the encoding distortion is minimum.

7 Claims, 9 Drawing Sheets

(56) References Cited

U.S. PATENT DOCUMENTS

| | | | | |
|---|---|---|---|---|
| 2005/0228653 | A1 | 10/2005 | Morii | |
| 2005/0256702 | A1* | 11/2005 | Vadapalli | 704/223 |
| 2006/0277036 | A1* | 12/2006 | Bessette et al. | 704/207 |
| 2007/0282603 | A1* | 12/2007 | Bessette | 704/219 |
| 2008/0126085 | A1* | 5/2008 | Morii | 704/222 |
| 2008/0319739 | A1* | 12/2008 | Mehrotra et al. | 704/200.1 |

FOREIGN PATENT DOCUMENTS

| | | |
|---|---|---|
| EP | 2 116 996 | 11/2009 |
| JP | 09-006396 | 1/1997 |
| JP | 11-501131 | 1/1999 |
| JP | 11-259098 | 9/1999 |
| JP | 2001-228888 | 8/2001 |
| JP | 2002-366199 | 12/2002 |
| JP | 2004-102186 | 4/2004 |
| WO | 96/28810 | 9/1996 |

OTHER PUBLICATIONS

R. Salami et al., "8kbit/s ACELP Coding of Speech with 10ms Speech-Frame: a Candidate for CCITT Standardization," IEEE, 2004, pp. 97-100.

T.Nomura et al., "Efficient pulse excitation search methods in CELP,"Proc. of the 1996 spring meeting of the Acoustic Society of Japan, 2-P-5, Mar. 1996, pp. 311-312, with English Translation.

Supplementary European Search Report dated Jun. 16, 2011.

R. Salami, et al., "ITU-T G.729 Annex A: Reduced Complexity 8 kb/s CS-ACELP Codec for Digital Simultaneous Voice and Data," XP-000704424, IEEE Communications Magazine, IEEE Service Center, Piscataway, vol. 35 No. 9, Sep. 1997, pp. 56-63.

C. Laflamme, et al., "16 KBPS Wideband Speech Coding Techinique Based on Algebraic CELP," S1.4, Communication Research Center, University of Sherbrooke, Quebec, Apr. 1991, pp. 13-16.

Chinese Office Action dated Nov. 2, 2011.

* cited by examiner

AUDIO ENCODING DEVICE AND AUDIO ENCODING METHOD

TECHNICAL FIELD

The present invention relates to a speech encoding apparatus and speech encoding method. In particular, the present invention relates to a speech encoding apparatus and speech encoding method for performing a fixed codebook search.

BACKGROUND ART

In mobile communication, compression coding for digital information about speech and images is essential for efficient use of transmission bands. Especially, expectations for speech codec (encoding and decoding) techniques widely used for mobile phones are high, and further improvement of sound quality is demanded for conventional high-efficiency coding of high compression performance.

Recently, standardization of scalable codec having a multilayer configuration is underway by, for example, ITU-T (International Telecommunication Union Telecommunication Standardization Sector) and MPEG (Moving Picture Expert Group), and more efficient and higher-quality speech codec is demanded.

The performance of speech coding technique, which has improved significantly by the basic scheme "CELP (Code Excited Linear Prediction)," modeling the vocal system of speech and adopting vector quantization skillfully, is further improved by fixed excitation techniques using a small number of pulses, such as the algebraic codebook disclosed in Non-Patent Document 1. ITU-T recommendation G.729 and ETSI (European Telecommunication Standard Institute) standard AMR (Adaptive Multi-Rate) proposes representative CELP codec using an algebraic codebook, and are widely used all over the world.

In the case of performing speech encoding using an algebraic codebook, taking into account the mutual influence between pulses forming the algebraic codebook, it is desirable to search all combinations of pulses (hereinafter "whole search"). However, when the number of pulses increases, the amount of calculations required for a search increases exponentially. By contrast with this, Non-Patent document 2 discloses, for example, partial search, pruning search and Viterbi search as algebraic codebook search methods to reduce the amount of calculations significantly and substantially maintain the performance in the case of the whole search at the same time.

Among these, especially, partial search is the simplest method providing an effect of reducing the amount of calculations significantly. Here, partial search is the method of dividing a closed loop into a plurality of smaller closed loops and performing an open-loop search in the plurality of closed loops. In this partial search, it is possible to reduce the amount of calculations significantly according to the number of divisions. Also, partial search is used in international standard schemes, and, in algebraic codebook search of ETSI standard AMR, which is the standard codec of the third-generation mobile phones, partial search is performed after dividing four pulses into two subsets.

For example, if there are four pulses having eight candidate positions, there are $8^4$ (i.e. 4096) combinations of pulses that need to be evaluated, to search for four pulses in one closed loop. By contrast with this, ETSI standard AMR divides four pulses into two subsets of two pulses and performs a search in their closed loops individually. Therefore, the number of combinations of pulses to be evaluated in ETSI standard AMR is $2\times8^2$ (i.e. 128), which is one thirty-second of the amount of calculations in the case of the whole search. Further, evaluation in ETSI standard AMR is performed for two pulses, which are less than four pulses, so that the amount calculations is further reduced.

Non-Patent Document 1: Salami, Laflamme, Adoul, "8 kbit/s ACELP Coding of Speech with 10 ms Speech-Frame: a Candidate for CCITT Standardization", IEEE Proc. ICASSP94, pp. II-97n Non-Patent Document 2: T. Nomura, K. Ozawa, M. Serizawa, "Efficient pulse excitation search methods in CELP", Proc. of the 1996 spring meeting of the Acoustic Society of Japan. 2-P-5, pp. 311-312, March. 1996

DISCLOSURE OF INVENTION

Problems to be Solved by the Invention

However, generally, the performance of speech encoding by an algebraic codebook partial search is lower than in the case of the whole search, because positions of two pulses that are determined at first are not always optimum.

Therefore, in partial search, the performance of speech encoding can be further improved depending on which pulses are selected to form a subset to be searched first. For example, it is possible to adopt the method of selecting two pulses out of four pulses in a random manner and performing a search, and, after this process is repeated several times, finding the pair of pulses by which the encoding performance is the highest. For example, by providing four kinds of subset pairs and searching these four pairs individually, it is possible to make speech encoding performance close to encoding performance in the whole search. In this case, 128 $(8^2\times2)\times4$ (i.e. 512) patterns of calculations are required, which is one eighth of the amount of calculations in the case of the whole search. Here, in the above examples, subsets are formed in an arbitrary manner, and there is no specific reason for any pairs to be searched first among four kinds of pairs. Therefore, if a search is performed in a plurality of cases individually, the resulting encoding performance shows large variations, and the total encoding performance is insufficient.

It is therefore an object of the present invention to provide a speech encoding apparatus and speech encoding method for performing an algebraic codebook partial search and improving encoding performance.

Means for Solving the Problem

The speech encoding apparatus of the present invention employs a configuration having: a calculating section that calculates correlation values in candidate pulse positions using a target signal and a plurality of pulses forming a fixed codebook, and calculates, on a per pulse basis, representative values of the pulses using maximum values of the correlation values; a sorting section that sorts the representative values acquired on a per pulse basis, groups pulses corresponding to the sorted representative values into a plurality of predetermined subsets and determines a first subset to be searched first among the plurality of subsets; and a search section that searches the fixed codebook using the first subset and acquires a code indicating positions and polarities of the plurality of pulses for minimizing coding distortion.

The speech encoding method of the present invention includes the steps of: calculating correlation values in candidate pulse positions using a target signal and a plurality of pulses forming a fixed codebook, and calculating, on a per pulse basis, representative values of the pulses using maximum values of the correlation values; sorting the representative values acquired on a per pulse basis, grouping pulses corresponding to the sorted representative values into a plurality of predetermined subsets and determining a first subset to be searched first among the plurality of subsets; and searching the fixed codebook using the first subset and generating a code indicating positions and polarities of the plurality of pulses for minimizing coding distortion.

Advantageous Effect of the Invention

According to the present invention, upon performing a fixed codebook partial search in speech encoding, the subset to be searched first is determined using representative values relating to pulses such as the maximum correlation values, so that it is possible to perform an algebraic codebook partial search and improve encoding performance.

BEST MODE FOR CARRYING OUT THE INVENTION

Embodiments of the present invention will be explained below in detail with reference to the accompanying drawings.

Embodiment 1

Figure 1:
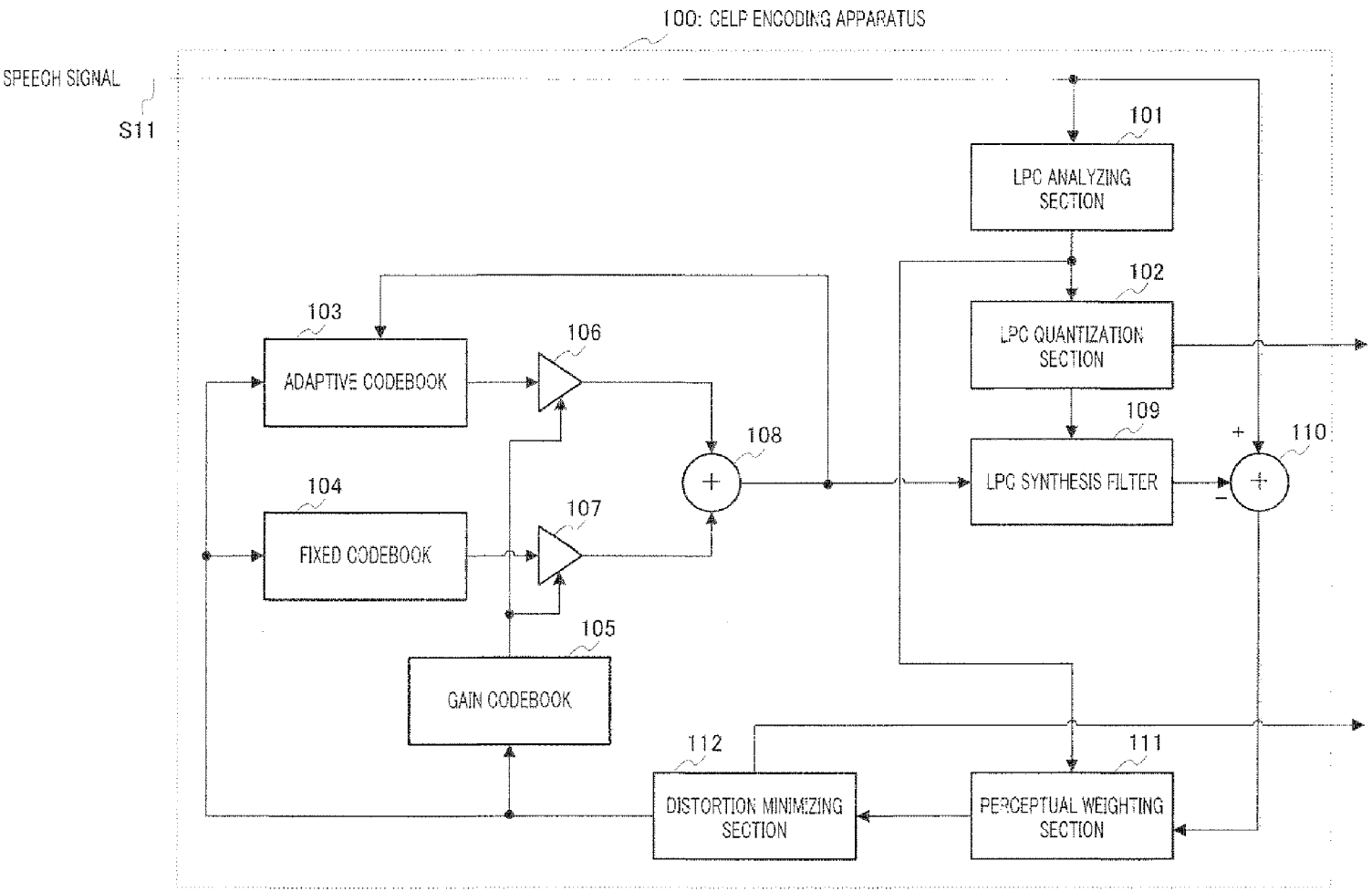
FIG. 1 is a block diagram showing the configuration of a CELP encoding apparatus according to Embodiment 1 of the present invention.

FIG. 1 is a block diagram showing the configuration of CELP encoding apparatus 100 according to Embodiment 1 of the present invention. Here, an example case will be explained using a CELP encoding apparatus as the speech encoding apparatus according to the present invention.

In FIG. 1, for speech signal S11 comprised of vocal tract information and excitation information, CELP encoding apparatus 100 encodes the vocal tract information by calculating LPC (Linear Prediction Coefficient) parameters and encodes the excitation information by determining an index specifying which speech model stored in advance to use. That is, the excitation information is encoded by determining an index specifying what excitation vector (code vector) to generate in adaptive codebook 103 and fixed codebook 104.

To be more specific, the sections of CELP encoding apparatus 100 perform the following operations.

LPC analyzing section 101 performs a linear prediction analysis of speech signal S11, calculates LPC parameters that are spectrum envelope information and outputs the LPC parameters to LPC quantization section 102 and perceptual weighting section 111.

LPC quantization section 102 quantizes the LPC parameters outputted from LPC analyzing section 101, and outputs the resulting quantized LPC parameters to LPC synthesis filter 109 and an index of the quantized LPC parameters to the outside of CELP encoding apparatus 100.

On the other hand, adaptive codebook 103 stores past excitations used in LPC synthesis filter 109, and generates an excitation vector of one subframe from the stored excitations according to the adaptive codebook lag associated with an index designated from distortion minimizing section 112 described later. This excitation vector is outputted to multiplier 106 as an adaptive codebook vector.

Fixed codebook 104 stores in advance a plurality of excitation vectors of a predetermined shape, and outputs an excitation vector associated with an index designated from distortion minimizing section 112 to multiplier 107 as a fixed codebook vector. Here, fixed codebook 104 is an algebraic excitation, and a case will be explained where an algebraic codebook is used. Also, an algebraic excitation is an excitation adopted in many standard codecs.

Further, above adaptive codebook 103 is used to represent more periodic components like voiced speech, while fixed codebook 104 is used to represent less periodic components like white noise.

According to the designation from distortion minimizing section 112, gain codebook 105 generates a gain for the adaptive codebook vector that is outputted from adaptive codebook 103 (i.e., adaptive codebook gain) and a gain for the fixed codebook vector that is outputted from fixed codebook 104 (i.e., fixed codebook gain), and outputs these gains to multipliers 106 and 107, respectively.

Multiplier 106 multiplies the adaptive codebook vector outputted from adaptive codebook 103 by the adaptive codebook gain outputted from gain codebook 105, and outputs the result to adder 108.

Multiplier 107 multiplies the fixed codebook vector outputted from fixed codebook 104 by the fixed codebook gain outputted from gain codebook 105, and outputs the result to adder 108.

Adder 108 adds the adaptive codebook vector outputted from multiplier 106 and the fixed codebook vector outputted from multiplier 107, and outputs the resulting excitation vector to LPC synthesis filter 109 as an excitation.

LPC synthesis filter 109 generates a synthesis signal using a filter function including the quantized LPC parameters outputted from LPC quantization section 102 as a filter coefficient and the excitation vectors generated in adaptive codebook 103 and fixed codebook 104 as excitations, that is, using an LPC synthesis filter. This synthesis signal is outputted to adder 110.

Adder 110 calculates an error signal by subtracting the synthesis signal generated in LPC synthesis filter 109 from speech signal S11, and outputs this error signal to perceptual weighting section 111. Here, this error signal is equivalent to coding distortion.

Perceptual weighting section 111 performs perceptual weighting for the coding distortion outputted from adder 110, and outputs the result to distortion minimizing section 112.

Distortion minimizing section 112 finds the indices of adaptive codebook 103, fixed codebook 104 and gain codebook 105 on a per subframe basis, so as to minimize the coding distortion outputted from perceptual weighting section 111, and outputs these indices to the outside of CELL encoding apparatus 100 as encoded information. To be more specific, distortion minimizing section 112 generates a synthesis signal based on above adaptive codebook 103 and fixed codebook 104. Here, a series of processing to find the coding distortion of this signal forms closed-loop control (feedback control). Further, distortion minimizing section 112 searches the codebooks by variously changing indices that designate the codebooks in one subframe, and outputs the resulting indices of the codebooks minimizing the coding distortion.

Also, the excitation when the coding distortion is minimized is fed back to adaptive codebook 103 on a per subframe basis. Adaptive codebook 103 updates stored excitations by this feedback.

The method of searching fixed codebook 104 will be explained below. First, an excitation vector search and code calculation are performed by searching for an excitation vector to minimize the coding distortion in following equation 1.

[1]

$$E=|x-(pHa+qHs)|^2 \quad \text{(Equation 1)}$$

where:
E: coding distortion;
x: coding target;
P: adaptive codebook vector gain;
H: perceptual weighting synthesis filter;
a: adaptive codebook vector;
q: fixed codebook vector gain; and
a: fixed codebook vector Generally, an adaptive codebook vector and a fixed codebook vector are searched for in open-loops (that is, in separate loops), and, consequently, a code of adaptive codebook 104 is derived by searching for a fixed codebook vector to minimize the coding distortion shown in following equation 2.

[2]

$$y=x-pHa$$

$$E=|y-qHs|^2 \quad \text{(Equation 2)}$$

where:
E: coding distortion
x: coding target (perceptually weighted speech signal
p: optimal adaptive codebook vector gain;
H: perceptual weighting synthesis filter;
a: adaptive codebook vector;
q: fixed codebook vector gain;
s: fixed codebook vector; and
y: target vector in a fixed codebook search Here, gains p and q are determined after an excitation code is searched for, so that a search is performed using optimal gains. Then, above equation 2 can be expressed by following equation 3.

(Equation 3)

$$y = x - \frac{x \cdot Ha}{|Ha|^2} Ha \qquad [3]$$

$$E = \left| y - \frac{y \cdot Hs}{|Hs|^2} Hs \right|^2$$

Further, minimizing this equation of distortion is equivalent to maximizing the function C of following equation 4.

(Equation 4)

$$C = \frac{(yH \cdot s)^2}{sHHs} \qquad [4]$$

Therefore, in the ease of searching for an excitation comprised of a small number of pulses such as an algebraic codebook excitation, by calculating yH and HH in advance, it is possible to calculate the above function C with a small amount of calculations. Here, elements of vector yH correspond to the pulse-specific correlation values. That is, an element of yH acquired by performing a time reverse synthesis of target y, is equivalent to the correlation value between a synthesis signal of the pulse that rises in that position and the target signal.

Figure 2:
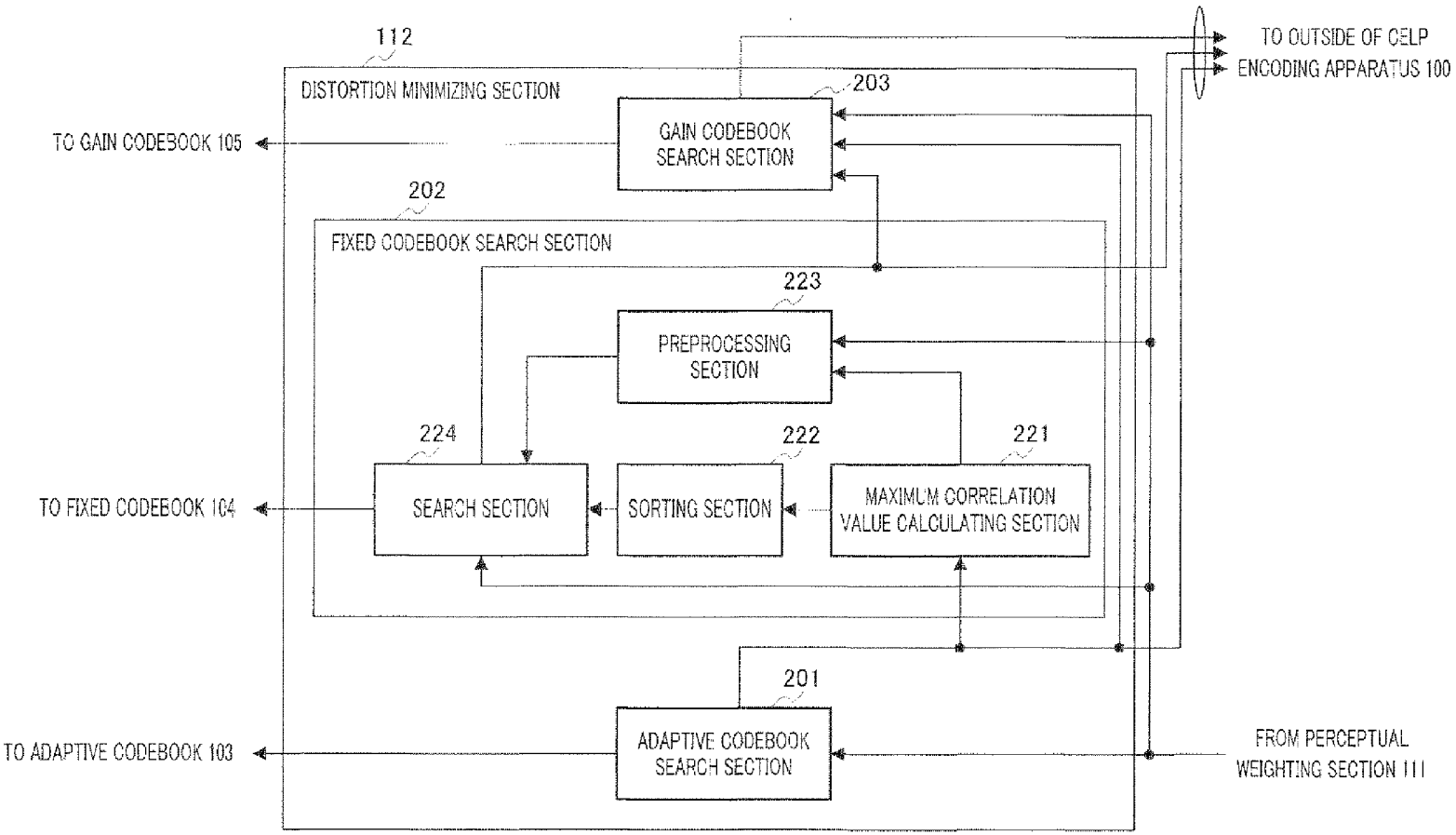
FIG. 2 is a block diagram showing the configuration inside a distortion minimizing section according to Embodiment 1 of the present invention.

FIG. 2 is a block diagram showing the configuration inside distortion minimizing section 112 according to the present embodiment. Here, an example case will be explained where, in a fixed codebook search in distortion minimizing section 112, four pulses forming an algebraic codebook are divided into two subsets of two pulses and searched. Also, assume that each pulse has eight candidate positions.

In FIG. 2, distortion minimizing section 112 is provided with adaptive codebook search section 201, fixed codebook search section 202 and gain codebook search section 203. Also, fixed codebook search section 202 is provided with maximum correlation value calculating section 221, sorting section 222, preprocessing section 223 and search section 224.

Adaptive codebook search section 201 searches adaptive codebook 103 using coding distortion subjected to perceptual weighting in perceptual weighting section 111. Adaptive codebook search section 201 outputs the adaptive codebook vector code acquired in the search step to adaptive codebook 103, outputs the adaptive codebook vector code acquired as a search result to maximum correlation value calculating section 221 in fixed codebook search section 202 and to the outside of CELP encoding apparatus 100.

Fixed codebook search section 202 performs an adaptive codebook partial search using coding distortion subjected to perceptual weighting in perceptual weighting section 111 and the adaptive codebook vector code received as input from adaptive codebook search section 201. Further, fixed codebook search section 202 outputs the fixed codebook vector code acquired in the search step to fixed codebook 104, and outputs the fixed codebook vector code acquired as a search result to the outside of CELP encoding apparatus 100 and to gain codebook search section 203.

Gain codebook search section 203 searches a gain codebook based on the fixed codebook vector code received as input from search section 224 in fixed codebook search section 202, coding distortion subjected to perceptual weighting in perceptual weighting section 111 and the adaptive codebook vector code received as input from adaptive codebook search section 201. Further, gain codebook search section 203 outputs the adaptive codebook gain and fixed codebook gain acquired in the search step to gain codebook 105, and outputs the adaptive codebook gain and fixed codebook gain acquired as search results to the outside of CELP encoding apparatus 100.

Maximum correlation value calculating section 221 calculates an adaptive codebook vector using the adaptive codebook vector code received as input from adaptive codebook search section 201, and calculates target vector y shown in equation 2. Further, using the synthesis filter coefficient H in perceptual weighting section 111, maximum correlation value calculating section 221 calculates and outputs the pulse-specific correlation value yH in each candidate position to preprocessing section 223. Further, using the pulse-specific correlation value in each candidate position, maximum correlation value calculating section 221 calculates and outputs the maximum correlation values of individual pulses to sorting section 222. Here, calculation of the maximum correlation values in maximum correlation value calculating section 221 will be described later in detail.

Sorting section 222 sorts the maximum correlation values of individual pulses received as input from maximum correlation value calculating section 221, in order from the largest maximum correlation value (hereinafter referred to as "sorting processing"). Further, based on the sorting result, sorting section 222 divides four pulses into two subsets of two pulses and outputs the division results to search section 224. Sorting processing in sorting section 222 will be described later in detail.

Preprocessing section 223 calculates a matrix HH using the synthesis filter coefficient H in perceptual weighting section 111. Further, from the polarities (+ and −) of the elements of vector yH received as input from maximum correlation value calculating section 221, preprocessing section 223 determines and outputs the polarities of the pulses, pol, to search section 224. To be more specific, in preprocessing section 223, the polarities of individual pulses that rise in respective positions are coordinated with the polarities of the values of yH in those positions, and the polarities of the values of yH are stored in a different sequence. After the polarities in these positions are stored in a different sequence, preprocessing section 223 makes all of the values of yH absolute values, that is, preprocessing section 223 converts the values of yH into positive values. Further, to convert the polarities of the values of HH, preprocessing section 223 multiplies the values of HH by polarities in coordination with the stored polarities in those positions. The calculated yH and HH are outputted to search section 224.

Search section 224 performs a fixed codebook partial search using the division results received as input from sorting section 222, the coding distortion subjected to perceptual weighting in perceptual weighting section 111, and yH and HH received as input from preprocessing section 223. Search section 224 outputs the fixed codebook vector code acquired in the search step to fixed codebook 104 and outputs the fixed codebook vector code acquired as a search result to the outside of CELP encoding apparatus 100 and gain codebook search section 203. Also, the fixed codebook partial search in search section 224 will be described later in detail.

Next, the process of calculating the maximum correlation value of each pulse in maximum correlation value calculating section 221 will be explained in detail.

Figure 3:
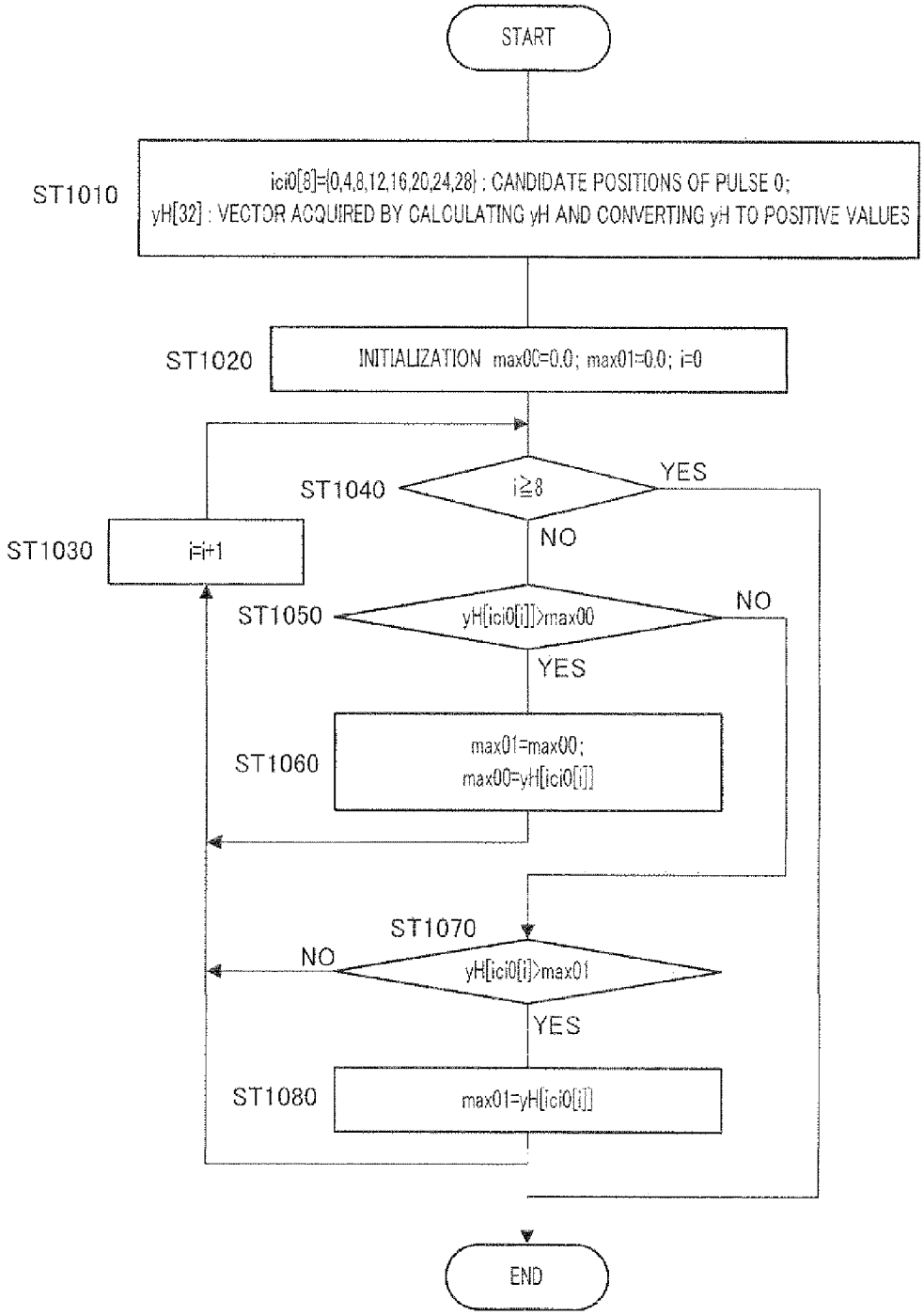
FIG. 3 is a flowchart showing the steps of calculating the maximum correlation value of each pulse in a maximum correlation value calculating section according to Embodiment 1 of the present invention.

FIG. 3 is a flowchart showing the steps of calculating the maximum correlation value of each pulse in maximum correlation value calculating section 221. Here, a processing example will be explained where maximum correlation value calculating section 221 finds two candidate positions where the value of pulse 0 (yH) is the highest, and, based on these positions, calculates the maximum correlation value of pulse 0.

First, maximum correlation value calculating section 221 ensures sequence ici0[8] of predetermined candidate positions of pulse 0 and sequence yH[32] acquired by converting the correlation value yH that is used for search into a positive value (ST 1010).

Next, maximum correlation value calculating section 221 initializes the maximum value max00, the semi-maximum value (i.e. the second highest value) max01 and counter i (ST 1020), and the step moves to the loop formed with ST 1030 to ST 1080.

In this loop, when the value of counter i is equal to or greater than 8 ("YES" in ST 1040), maximum correlation value calculating section 221 decides that the loop processing for each candidate position is finished completely, and finishes the process. By contrast, when the value of counter i is less than 8 ("NO" in ST 1040), maximum correlation value calculating section 221 decides that loop processing is not finished completely, and the step moves to ST 1050.

Next, if the correlation value yH[ici0[i]] in a position indicated by counter i is greater than the maximum value max00 ("YES" in ST 1050), maximum correlation value calculating section 221 stores the maximum value max00 as a semi-maximum value max01, assigns the correlation value yH[ici0[i]] in the position indicated by counter i to a maximum value max00 (ST 1060), and returns the step to ST 1030. If the correlation value yH[ici0[i]] in the position indicated by counter i is equal to or less than the maximum value max00 ("NO" in ST 1050), maximum correlation value calculating section 221 moves the step to ST 1070.

Next, if the correlation value yH[ici0[i]] in a position indicated by counter i is greater than the semi-maximum value max01 ("YES" in ST 1070), maximum correlation value calculating section 221 assigns the correlation value yH[ici0[i]] in the position indicated by counter i to the semi-maximum value max01 (ST 1060), and returns the step to ST 1030 (ST 1080). By contrast, if the correlation value yH[ici0[i]] in a position indicated by counter i is equal to or less than the semi-maximum value max01 ("NO" in ST 1070), maximum correlation value calculating section 221 returns the step to ST 1030.

Next, in ST 1030, maximum correlation value calculating section 221 increments counter i by one and returns the step to ST 1040.

Thus, maximum correlation value calculating section 221 calculates the maximum value max00 and the semi-maximum value max01 among correlation values of single pulse 0 in candidate positions. Further, using the steps shown in FIG. 3, maximum correlation value calculating section 221 finds two candidate positions where the correlation values (yH) of individual pulses 1, 2 and 3 are the highest. That is, maximum correlation value calculating section 221 finds max10, max11, max20, max21, max30 and max 31, which represent the maximum values and the semi-maximum values of individual pulses 1, 2 and 3.

Figure 5:
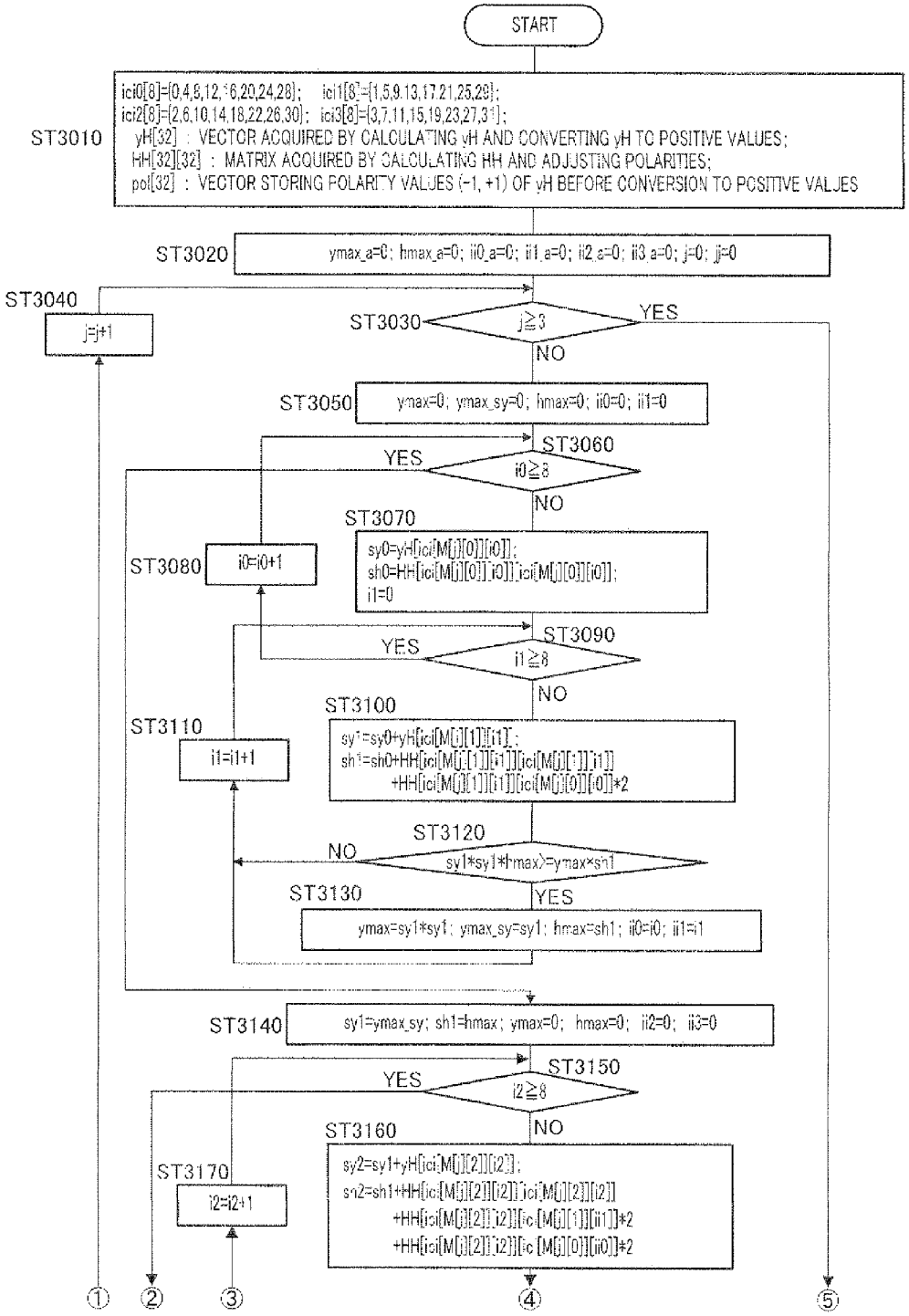
FIG. 5 is a flowchart showing the steps of a fixed codebook partial search in a search section according to Embodiment 1 of the present invention.

Next, using the maximum values and the semi-maximum values among correlation values of individual pulses 0, 1, 2 and 3, maximum correlation value calculating section 221 calculates the maximum correlation values S[0], S[1], S2[2] and S[3] of individual pulses according to following equation 5. As shown in FIG. 5, maximum correlation value calculating section 221 finds the stable maximum correlation values associated with individual pulses by adding the semi-maximum value of correlation value at a predetermined rate to the maximum value of correlation value on a per pulse basis.

$$S[0]=\max 00+\max 01\times 0.05$$

$$S[1]=\max 10+\max 11\times 0.05$$

$$S[2]=\max 20+\max 21\times 0.05$$

$$S[3]=\max 30+\max 31\times 0.05 \quad \text{(Equation 5)}$$

Next, sorting processing on the maximum correlation value of each pulse in sorting section 222 will be explained in detail.

Figure 4:
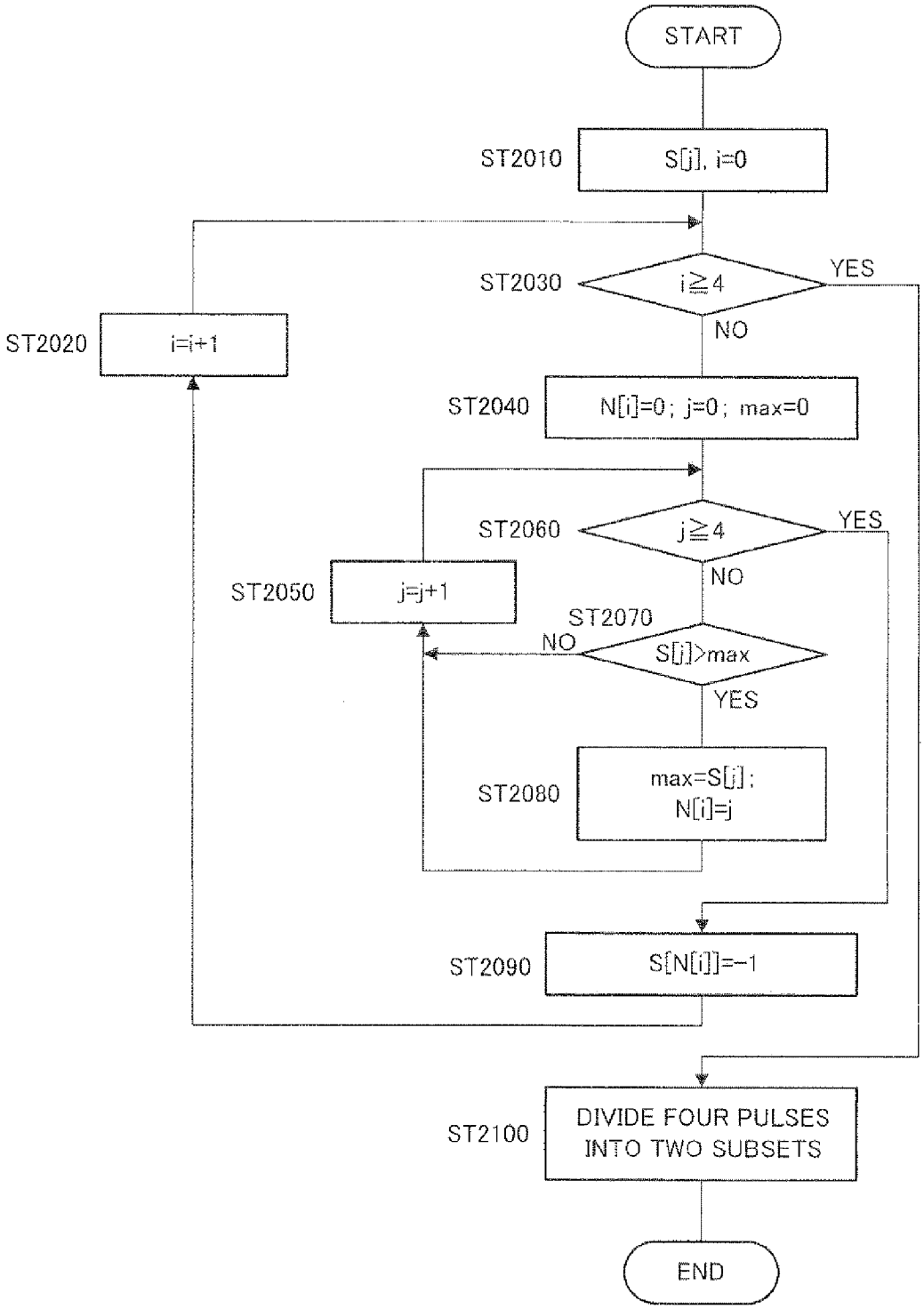
FIG. 4 is a flowchart showing the steps of sorting processing on the maximum correlation value of each pulse in a sorting section according to Embodiment 1 of the present invention.

FIG. 4 is a flowchart showing the steps of sorting processing of the maximum correlation values of individual pulses in sorting section 222.

First, sorting section 222 receives as input the maximum correlation value S[j] (j=0, 1, 2, 3) of each pulse from maximum correlation value calculating section 221, and resets, to 0, counter i indicating until which rank sorting is completed (ST 2010).

Next, when the value of counter i is equal to or greater than 4 ("YES" in ST 2030), sorting section 222 decides that sorting is finished completely, and moves the step to ST 2100. By contrast, when the value of counter i is less than 4 ("NO" in ST 2030), sorting section 222 assigns 0 to the pulse number N[i], resets counter j for counting the number of loops in which the i-th maximum correlation value S[N(i)] is searched for, to 0, and resets the variable "max" that stores the maximum value to 0 (ST 2040).

Next, when the value of counter j is less than 4 ("NO" in ST 2060), sorting section 222 moves the step to ST 2070.

Next, when the maximum correlation value S[j] is greater than the variable "max" ("YES" in ST 2070), sorting section 222 assigns the maximum correlation value S[j] to the variable "max," assigns the value of counter j to the pulse number N[i] corresponding to the i-th maximum correlation value S[N[i]] (ST 2080), and moves the step to ST 2050. By contrast, when the maximum correlation value S[j] is equal to or less than the variable "max" ("NO" in ST 2070), sorting section 222 moves the step to ST 2050. Next, in ST 2050, sorting section 222 increments counter j by one and returns the step to ST 2060.

By contrast, when the value of counter j is equal to or greater than 4 in ST 2060 ("YES" in ST 2060), sorting section 222 decides that the loop formed with ST 2050 to ST 2080 for searching for the i-th maximum correlation value S[N[i]] ends, and assigns "−1" to the i-th maximum correlation value S[N[i]] (ST 2090). By this means, the i-th maximum correlation value S[N[i]] is excluded from the target of loop processing for searching for the (i+1)-th maximum correlation value S[N[i+1]]. Next, sorting section 222 increments counter i by one in ST 2020 and returns the step to ST 2030.

Thus, sorting section 222 sorts the maximum correlation values S[0], S[1], S[2] and S[3] of individual pulses in descending order, and acquires N[i] indicating the sorting result. In the following, an example case will be explained where sorting section 222 acquires N[i]={2, 0, 3, 1}. That is, assume that the pulse number N[0] corresponding to the highest maximum correlation value S[N[0]] is 2, followed by 0, 3 and 1, in order.

Next, in ST 2100, sorting section 222 determines the order of search of pulses by grouping four pulse numbers, N[i], corresponding to the sorted maximum correlation values, into two predetermined subset division patterns, and outputs the resulting order of search to search section 224. That is, before fixed codebook partial search in search section 224, sorting section 222 determines the numbers of two pulses to be searched for first and the numbers of two pulses to be searched for next. In sorting section 222, three candidate patterns of order of search shown in following equation 6 are set in advance.

| | {First subset} | {Second subset} | |
|---|---|---|---|
| First candidate: | {N[0], N[1]} | {N[2], N[3]} | (Equation 6) |
| Second candidate: | {N[0], N[2]} | {N[3], N[1]} | |
| Third candidate: | {N[0], N[3]} | {N[1], N[2]} | |

In partial search, there are many kinds of division patterns for the subset to be searched first (i.e. first subset) and for the subset to be searched next (i.e. second subset). Of these division patterns, as shown in equation 6, by adopting the division pattern where pulse N[0] of the highest maximum correlation value is included in the subset to be searched first (i.e. first subset), it is possible to provide good encoding performance.

In each candidate order of search in equation 6, a search is performed in the order from the subset to be searched first (first subset) to the subset to be searched second (second subset).

If N[i] in equation 6 is expressed by specific values acquired by sorting, following equation 7 is acquired, and a search is performed in the order from the first candidate, the second candidate to the third candidate.

| | {First subset} | {Second subset} | |
|---|---|---|---|
| First candidate: | {2, 0} | {3, 1} | (Equation 7) |
| Second candidate: | {2, 3} | {1, 0} | |
| Third candidate: | {2, 1} | {0, 3} | |

The three orders of search shown in equation 7 can be grouped into M[3][4] shown in following equation 8. Here, M[3][4] represents the order of search of pulses in the case of performing a partial search for a set of four pulses three times.

$$M[3][4]=\{\{2,0,3,1\},\{2,3,1,0\},\{2,1,0,3\}\} \quad \text{(Equation 8)}$$

That is, sorting section 222 outputs M[3][4] to search section 224 as the order of search.

Next, a fixed codebook partial search in search section 224 will be explained in detail.

Figure 6:
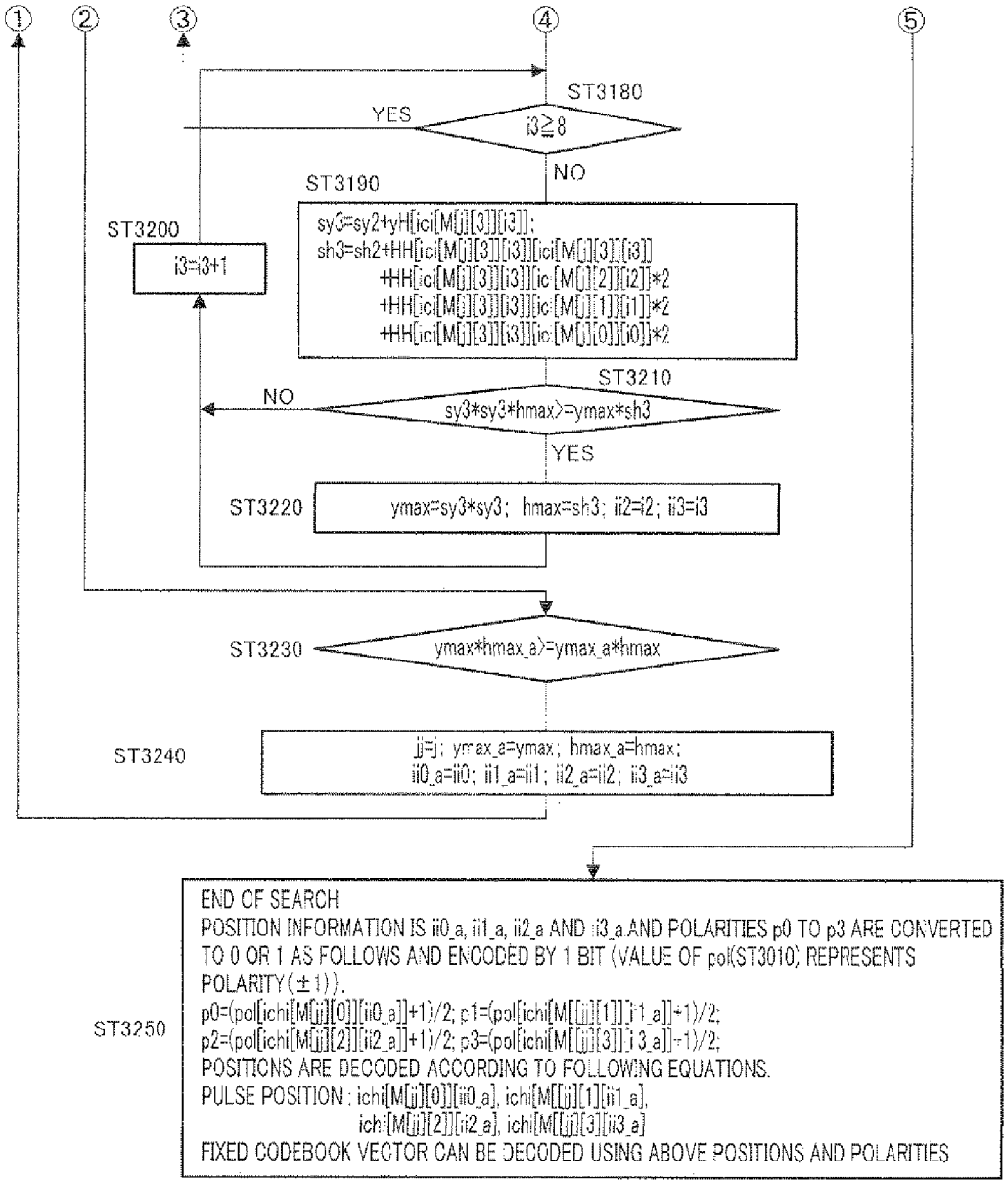
FIG. 6 is another flowchart showing the steps of a fixed codebook partial search in a search section according to Embodiment 1 of the present invention.

FIG. 5 and FIG. 6 are flowcharts showing the steps of a fixed codebook partial search in search section 224. Here, the parameters of an algebraic codebook are shown below.

| | | |
|---|---|---|
| (1) | the number of bits: | 16 bits |
| (2) | unit of processing (subframe length): | 32 |
| (3) | the number of pulses: | 4 |

With these parameters, the following algebraic codebook is designed.

$$ici0[8]=\{0,4,8,12,16,20,24,28\}$$

$$ici1[8]=\{1,5,9,13,17,21,25,29\}$$

$$ici2[8]=\{2,6,10,14,18,22,26,30\}$$

$$ici3[8]=\{3,7,11,15,19,23,27,31\}$$

First, in ST 3010, search section 224 prepares sequences ici0[8], ici1[8], ici2[8] and ici3[8] indicating candidate positions of the four pulses of the fixed codebook, and prepares sequence yH[32] acquired by converting yH into positive values, sequence HH[32][32] acquired by adjusting the polarities of HH, and vector pol[32] storing the polarity values (−1, +1) of yH before yH is converted into the positive values. Next, in ST 3020, variables that are used in the subsequent search loop are initialized.

Search section 224 compares "j" and the value "3" in ST 3030, and, if "j" is equal to or greater than 3, moves the step to ST 3250 for finishing a search, and, if "j" is less than 3, moves the step to initialization ST 3050. In ST 3040, "j" is incremented by one. By this means, search section 224 performs a partial search for a set of two subsets three times, according to the three orders of search shown in searching order M[3][4] received as input from sorting section 222.

ST 3050 to ST 3130 show search loop processing of the first subset. To be more specific, in ST 3050, the search loop for the first subset is initialized. Next, in ST 3060, search section 224 compares i0 and the value "8," and, if i0 is equal to or greater than 8, moves the step to ST 3140 for initialization of the next search loop, or, if i0 is less than 8, moves the step to step ST 3070. In ST 3070, the correlation value sy0 and excitation power sh0 of a pulse indicated by M[j][0] (j=0, 1, 2) are calculated. Further, counter i1 is initialized to zero. Next, in ST 3080, is incremented by one. By this means, search section 224 performs loop processing eight times for eight candidate pulse positions indicated by M[j][0] (j=0, 1, 2). Similarly, in ST 3090 to ST 3130, search section 224 performs loop processing eight times for eight candidate pulse positions indicated by M[j][1] (j=0, 1, 2).

First, "i1" and the value "8" are compared in decision ST 3090, and, if "i1" is equal to or greater than 8, the step moves to increment step ST 3080, or, if "i1" is less than 8, the step moves to step ST 3100. In ST 3100, search section 224 calculates the correlation value sy1 and excitation power sh1 of a pulse indicated by M[j][1] (j=0, 1, 2) using the correlation value sy0 and the excitation power sh0 calculated in ST 3070 in addition to yH and HH received as input from preprocessing section 223.

In ST 3120, search section 224 calculates and compares the values of the function C according to equation 4, using the correlation values and excitation powers of individual pulses that are the processing targets in the first subset, overwrites and saves i0 and i1 of higher function values in ii0 and ii1, and further overwrites and saves the numerator term and denominator term of the function C (ST 3130). Here, in ST 3120, division requiring a large amount of calculations is avoided, and the calculation and comparison are performed by cross-multiplying the denominator terms and the numerator terms. In the above decision, if the correlation values are lower or if the correlation values are higher and processing in ST 3130 is performed, the step moves to increment step ST 3110. In increment step ST 3110, "i1" is incremented by one.

ST 3140 to ST 3220 shows search loop processing of the second subset. Here, the search loop processing of the second subset adopts basically the same steps as in the search loop processing of the first subset shown in ST 3050 to ST 3130. Here, only differences from the search loop processing of the first subset will be described. First, in ST 3140, the initialization of search loop processing of the second subset is performed using the result of search loop processing of the first subset. Also, the processing target of search loop processing of the second subset is the pulses indicated by M[j][2] (j=0, 1, 2) and M[j][3] (j=0, 1, 2). Also, in ST 3160, the correlation value sy2 and excitation power sh2 of pulse 2 are calculated using counter information ii0 and ii1 that are searched for and stored in the search loop for the first subset. Also, similarly, in ST 3190, the correlation value sy3 and excitation power sh3 of pulse 3 are calculated using counter information ii0 and ii1 that are searched for and stored in the search loop for the first subset.

Next, in ST 3230 and ST 3240, search section 224 finds the combination of pulse positions in which the value of the function C is the highest in the whole partial search.

Next, in ST 3250, search section 224 decides ii0, ii1, ii2 and ii3 as position information of pulses. Also, the value of sequence poi represents a polarity (±1), and search section 224 converts polarities p0, p1, p2 and p3 to 0 or 1 according to following equation 9, and encodes the results by one bit.

$$p0=(\mathrm{pol}[ichi0[ii0]]+1)/2$$

$$p1=(\mathrm{pol}[ichi1[ii1]]+1)/2$$

$$p2=(\mathrm{pol}[ichi2[ii2]]+1)/2$$

$$p3=(\mathrm{pol}[ichi3[ii3]]+1)/2 \qquad \text{(Equation 9)}$$

Here, as the decoding method of position information and polarities, pulse positions are decoded using ichi0[ii0], ichi1[ii1], ichi2[ii2] and ichi3[ii3], and a fixed codebook vector is decoded using the decoded positions and polarities.

As shown in FIG. 5 and FIG. 6, search section 224 performs a partial search for two subsets, so that it is possible to reduce the amount of calculations significantly, compared to the case of a whole search. To be more specific, while loop processing are performed 4096 ($8^4$) times in a whole search, according to the method shown in FIG. 5 and FIG. 6, loop processing are performed 64 ($8^2$) times for search in each two subsets. Further, according to M[3][4], a partial search for a set of two subsets is performed three times, and, as a result, loop processing is performed 384 (64×2 (subsets)×3) times in total. This is one tenth of the amount of calculations in the case of a whole search.

Thus, according to the present embodiment, a fixed codebook partial search is performed, so that it is possible to reduce the amount of calculations, compared to the case of performing a whole search.

Further, according to the present embodiment, in a partial search, upon dividing pulses forming a fixed codebook into a subset to be searched first and a subset to be searched next, the subset to be searched first is formed using the pulse of the highest maximum correlation value, so that it is possible to suppress coding distortion caused by partial search. That is, even in the case of performing a whole search, a pulse in a position of a higher maximum correlation value is likely to be adopted, so that it is possible to suppress coding distortion by searching the pulse in advance in a partial search.

Also, although a case has been described above with the present embodiment where the number of pulses is four and the number of divisions is two, the present invention does not depend on the number of pulses or the number of divisions, and, by determining the order of pulses to be searched for based on a result of sorting the maximum correlation values of individual pulses, it is possible to provide the same effect as the present embodiment.

Also, an example case has been described above with the present embodiment where maximum correlation value calculating section 221 calculates the maximum correlation value by adding the semi-maximum value of correlation value at a predetermined rate to the maximum value of correlation value on a per pulse basis. However, the present invention is not limited to this, and it is equally possible to calculate the maximum correlation values by adding the third highest correlation values at a predetermined rate to the above values in individual pulses, or it is equally possible to use the maximum value among correlation values of individual pulses as is for the maximum correlation values.

Also, although an example case has been described above with the present embodiment where the candidate positions of each pulse are not selected preliminarily, the present invention is not limited to this, and it is equally possible to perform sorting after the candidate positions of each pulse are selected preliminarily. By this means, it is possible to improve the efficiency of sorting.

Also, although an example case has been described above with the present embodiment where an algebraic codebook is used as a fixed codebook, the present invention is not limited to this, and it is equally possible to use a multi-pulse codebook as a fixed codebook. That is, it is possible to implement the present embodiment using position information and polarity information of multiple pulses.

Also, although an example case has been described above with the present embodiment where the CELP encoding scheme is used as a speech encoding scheme, the present invention is not limited to this, and an essential requirement is to adopt an encoding scheme using a codebook that stores excitation vectors, where the number of the excitation vectors is known. This is because partial search according to the present invention is performed only for fixed codebook search, and does not depend on whether or not an adaptive codebook is present, and whether or not the method of analyzing a spectrum envelope is one of LPC, FFT and a filter bank.

Embodiment 2

Embodiment 2 of the present invention is basically the same as Embodiment 1, and differs from Embodiment 1 only in the sorting processing in sorting section 222 (see FIG. 4). In the following, the sorting section in this present embodiment is assigned the reference numeral "422" and placed instead of sorting section 222, and only the sorting process in sorting section 422 (not shown) will be explained.

Figure 7:
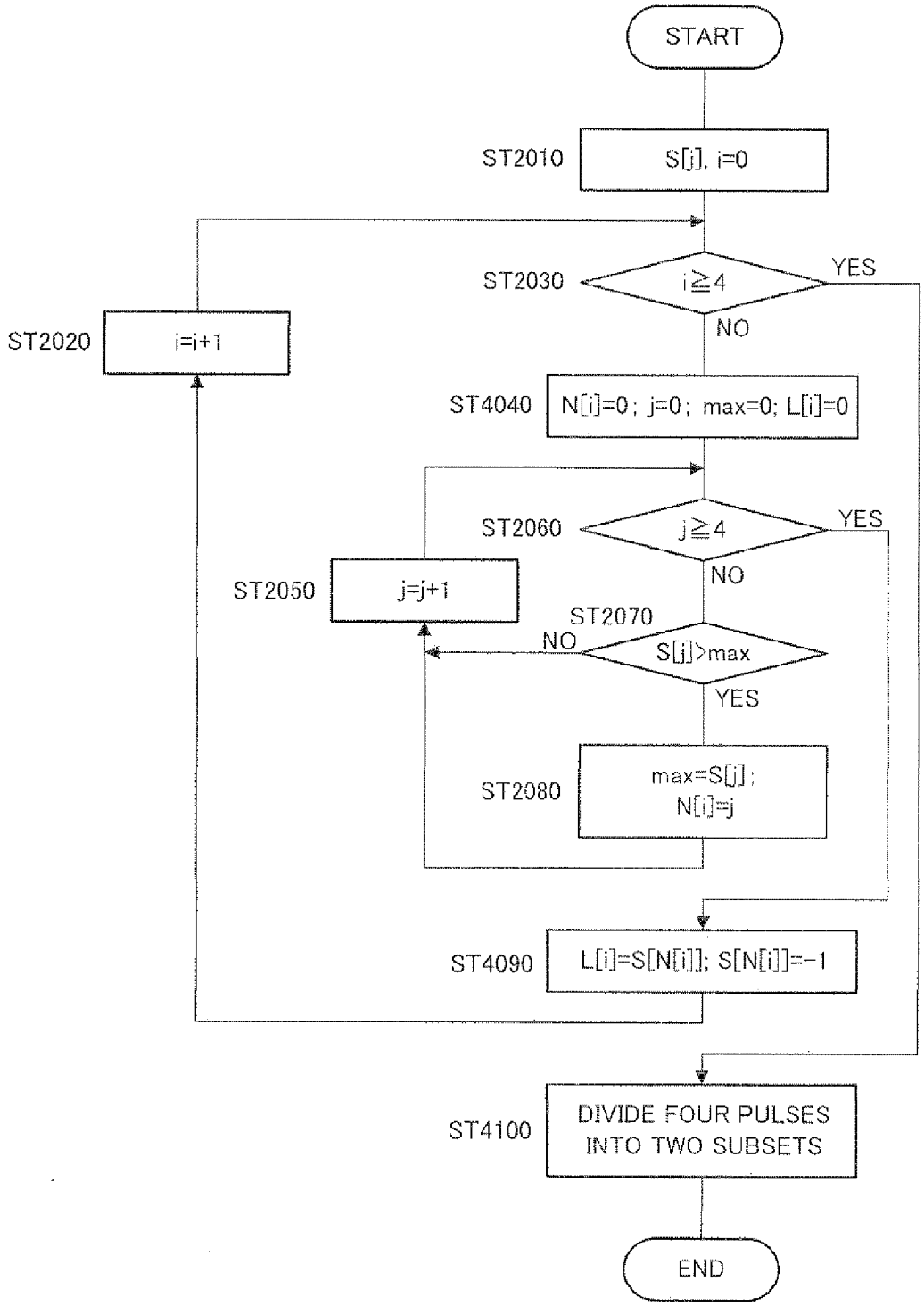
FIG. 7 is a flowchart showing the steps of sorting processing on the maximum correlation value of each pulse in a sorting section according to Embodiment 2 of the present invention.

FIG. 7 is a flowchart showing the steps of sorting processing of the maximum correlation value of each pulse in sorting section 422 according to the present embodiment. Here, the steps shown in FIG. 7 include basically the same steps as in FIG. 4, and, consequently, the same steps will be assigned the same reference numerals and their explanations will be omitted.

In ST 4040, sorting section 422 assigns "0" to the pulse number N[i], resets counter j that counts the number of loops for searching for the i-th maximum correlation value S[N[i]] to "0," resets the variable "max" storing the maximum value to "0" and assigns "0" to the variable L[i] for storing the i-th maximum correlation value S[N[i]].

In ST 4090, sorting section 422 assigns the i-th maximum correlation value S[N[i]] to L[i] and assigns "−1" to S[N[i]]. By this means, the i-th maximum correlation value S[N[i]] is stored in L[i] and also excluded from the target of loop processing for searching for the (i+1)-th maximum correlation value S[N[i+1]].

By processing in ST 2010 to ST 4090, sorting section 422 sorts the maximum correlation values S[0], S[1], S[2] and S[3] of individual pulses in descending order, and acquires N[i] and L[i] indicating the sorting result.

In ST 4100, sorting section 422 determines the order of search of pulses by grouping four pulse numbers, N[i], corresponding to the sorted maximum correlation values into two predetermined subset division patterns, and outputs the resulting order of search to search section 224. That is, before fixed codebook partial search in search section 224, sorting section 422 determines the numbers of two pulses to be searched for first and the numbers of two pulses to be searched for next. In sorting section 422, three candidate patterns of order of search are set in advance. Here, the difference from sorting section 222 of Embodiment 1 is that, for the third candidate, the order of search is determined using L[i] storing the maximum correlation values.

To be more specific, first, sorting section 422 sets two candidate orders of search of the first candidate and the second candidate shown in following equation 10, using sorting result N[i]. That is, as shown in equation 10, sorting section 422 includes the pulse of the highest maximum correlation value in the subset to be searched first in the first candidate and the second candidate, thereby improving encoding performance.

| | {First subset} | {Second subset} | |
|---|---|---|---|
| First candidate: | {N[0], N[1]} | {N[2], N[3]} | (Equation 10) |
| Second candidate: | {N[0], N[2]} | {N[3], N[1]} | |

Next, sorting section 422 sets a third candidate order of search using sorting result N[i] and L[i] as follows. That is, sorting section 422 decides whether or not L[2]+L[3] is equal to or greater than (L[0]+L[1])×0.91, and, if L[2]+L[3] is equal to or greater than (L[0]+L[1])×0.91, adopts {N[2], N[3]} {N[0], N[1]} as a third candidate. If L[2]+L[3] is less than (L[0]+L[1])×0.91, sorting section 422 then decides whether or not L[1]+L[3] is equal to or greater than (L[0]+L[2])×0.94. If L[1]+L[3] is equal to or greater than (L[0]+L[2])×0.94, sorting section 422 adopts {N[1], N[3]} {N[2], N[0]} as a third candidate. If L[1]+L[3] is less than (L[0]+L[2])×0.94, sorting section 422 then decides whether or not L[0]+L[3] is equal to or greater than L[1]+L[2]. If L[0]+L[3] is equal to or greater than L[1]+L[2], sorting section 422 generates {N[0], N[3]}{N[1], N[2]} as a third candidate, or, if L[0]+L[3] is less than L[1]+L[2], adopts {N[1], N[2]} {N[3], N[0]} as a third candidate.

Upon adopting a third candidate order of search, when differences between maximum correlation values of pulses are little, sorting section 422 forms the subset to be searched first, which does not always include the pulse of the highest maximum correlation value, to reduce the search redundancy in subsequent search section 224. That is, sorting section 442 forms a plurality of combinations of maximum correlation values of individual pulses based on sorting result N[i], and groups four pulses into two subsets based on a result of comparing the plurality of formed combinations multiplied by a coefficient.

For example, when N[i]={2, 0, 3, 1} and L[i]={9.5, 9.0, 8.5, 8.0} are found as a sorting result, L[2]+L[3] is less than (L[0]+L[1])><0.91 and L[1]+L[3] is equal to or greater than (L[0]+L[2])×0.94. Therefore, sorting section 422 adopts {N[1], N[3]} {N[2], N[0]} as a third candidate.

When N[i] is represented by specific values, the first, second and third candidates are expressed in following equation 11.

| | {First subset} | {Second subset} | |
|---|---|---|---|
| First candidate: | {2, 0} | {3, 1} | (Equation 11) |
| Second candidate: | {2, 3} | {1, 0} | |
| Third candidate: | {0, 1} | {3, 2} | |

The three candidate orders of search shown in equation 11 can be grouped into M[3][4] shown in following equation 12.

$$M[3][4]\{\{2,0,3,1\},\{2,3,1,0\},\{0,1,3,2\}\} \quad \text{(Equation 12)}$$

Sorting section 422 outputs M[3][4] to search section 224 as candidate orders of search.

Thus, according to the present embodiment, upon dividing pulses forming a fixed codebook into the subset to be searched first and the subset to be searched next in partial search, the subset to be searched first, which does not always include the pulse of the highest maximum correlation value, is formed based on not only the order of maximum correlation values of individual pulses but also the values of maximum correlation values of these pulses. By this means, it is possible to reduce the redundancy of search in partial search.

Also, although an example case has been described above with the present embodiment where coefficients such as 0.91 and 0.94 are used to adopt a third candidate order of search, the present invention is not limited to this, and it is equally possible to use other coefficients determined statistically in advance.

Also, although an example case has been described above with the present embodiment where L[i] is further used in addition to N[i] to adopt a third candidate order of search, the present invention is not limited to this, and it is equally possible to use both N[i] and L[i] even in the case of adopting a first candidate order of search or a second candidate order of search.

Embodiment 3

Embodiment 3 is basically the same as Embodiment 1, and differs from Embodiment 1 only in that pulses grouped into subsets are further rearranged according to a predetermined order. That is, the present embodiment differs from Embodiment 1 only in part of the sorting processing shown in FIG. 4. In the following, the sorting section in this present embodiment is assigned the reference numeral "522" and placed instead of sorting section 222, and only the sorting process in sorting section 522 (not shown) will be explained.

Figure 8:
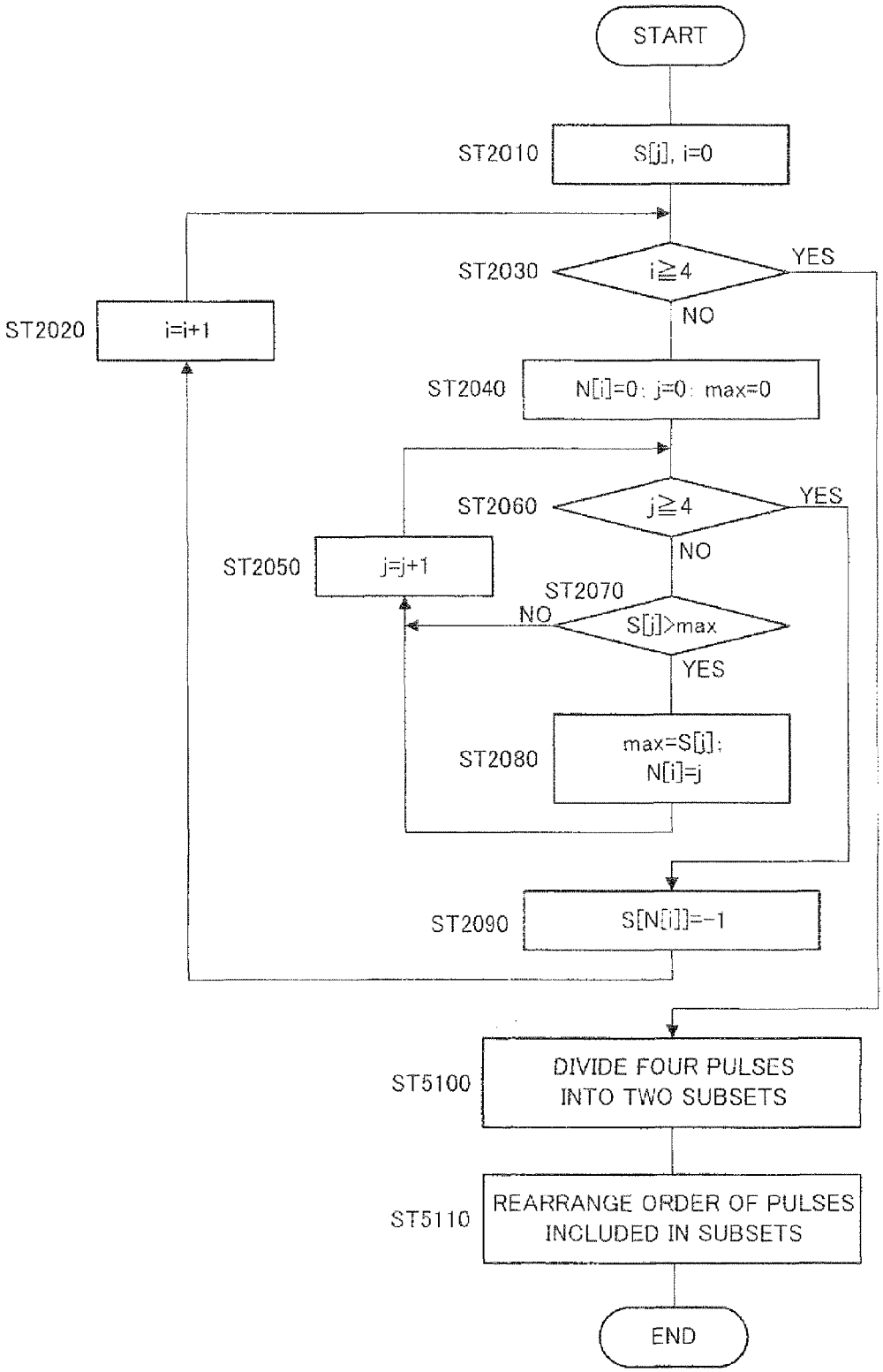
FIG. 8 is a flowchart showing the steps of sorting processing on the maximum correlation value of each pulse in a sorting section according to Embodiment 3 of the present invention.

FIG. 8 is a flowchart showing the steps of sorting processing of the maximum correlation values of individual pulses in sorting section 522 according to the present embodiment. Here, the steps shown in FIG. 8 include basically the same steps as in FIG. 4, and, consequently, the same steps will be assigned the same reference numerals and their explanations will be omitted.

In ST 5100 in FIG. 8, although sorting section 522 performs basically the same processing as the processing in ST 2100 in FIG. 4 performed by sorting section 222 according to Embodiment 1, sorting section 522 differs from sorting section 222 in not outputting resulting M[3][4] as is and in outputting it to search section 224 after the following processing in ST 5110 instead.

In ST 5110, sorting section 522 forms M'[6][2] by grouping elements included in M[3][4] into pairs of two pulses, and performs adjustment of rearranging the order of two pulses included in M'[6][2] to one of {0, 1}, {1, 2}, {2, 3}, {3, 0}, {0, 2} and {1, 3}.

Figure 9:
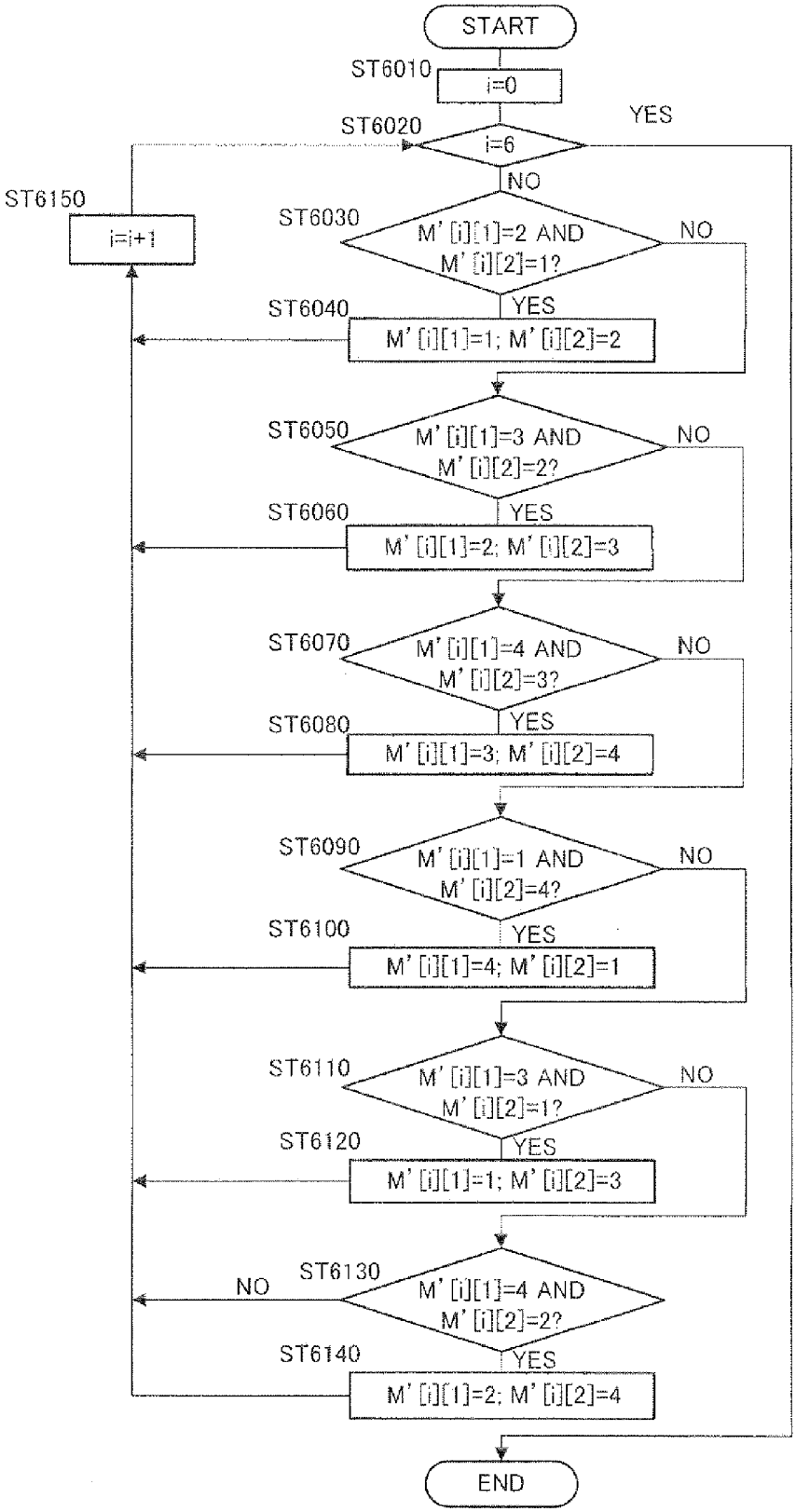
FIG. 9 is a flowchart showing the steps of rearrangement processing on the order of pulses in a sorting section according to Embodiment 3 of the present invention.

FIG. 9 is a flowchart showing the steps in sorting section 522 in ST 5110 shown in FIG. 8.

First, in ST 6010, sorting section 522 initializes the variable "i" to "0."

Next, in ST 6020, sorting section 522 decides whether or not "i" is equal to "6."

If it is decided in ST 6020 that "i" is equal to "6" ("YES" in ST 6020), sorting section 522 finishes the process shown in FIG. 9 (i.e. processing in ST 5110).

By contrast, if it is decided in ST 6020 that "i" is not equal to "6" ("NO" in ST 6020), sorting section 522 moves the step to ST 6030.

In ST 6030, sorting section 522 decides whether or not M'[i][1]="2" and M'[i][2]="1."

If it is decided in ST 6030 that M'[i][1]="2" and M'[i][2]="1" ("YES" in ST 6030), sorting section 522 sets M'[i][1] to "1" and M'[i][2] to "2" in ST 6040, and moves the step to ST 6150.

By contrast, if it is decided in ST 6030 that the two conditions M'[i][1]="2" and M'[i][2]="1" are not met at the same time ("NO" in ST 6030), sorting section 522 moves the step to ST 6050.

In ST 6050, sorting section 522 decides whether or not M'[i][1]="3" and M'[i][2]="2."

If it is decided in ST 6050 that M'[i][1]="3" and M'[i][2]="2" ("YES" in ST 6050), sorting section 522 sets M'[i][1] to "1" to "2" and W[i][2] to "3" in ST 6060, and moves the step to ST 6150.

By contrast, if it is decided in ST 6050 that the two conditions M'[i][1]="3" and M'[i][2]="2" are not met at the same time ("NO" in ST 6050), sorting section 522 moves the step to ST 6070.

In ST 6070, sorting section 522 decides whether or not M'[i][1]"4" and M'[i][2]="3."

If it is decided in ST 6070 that M'[i][1]="4" and M'[i][2]="3" ("YES" in ST 6070), sorting section 522 sets M'[i][1] to "3" and M'[i][2] to "4" in ST 6080, and moves the step to ST 6150.

By contrast, if it is decided in ST 6070 that the two conditions M'[i][1]="4" and M'[i][2]="3" are not net at the same time ("NO" in ST 6070), sorting section 522 moves the step to ST 6090.

In ST 6090, sorting section 522 decides whether or not M'[i][1]"1" and M'[i][2]="4."

If it is decided in ST 6090 that M'[i][1]"1" and M' [i][2]="4" ("YES" in ST 6090), sorting section 522 sets M'[i][1] to "4" and M'[i][2] to "1" in ST 6100, and moves the step to ST 6150.

By contrast, if it is decided in ST 6090 that the two conditions M'[i][1]"1" and M'[i][2]"4" are not met at the same time ("NO" in ST 6090), sorting section 522 moves the step to ST 6110.

In ST 6110, sorting section 522 decides whether or not M'[i][1]="3" and M'[i][2]="1."

If it is decided in ST 6110 that M'[i][1]="3" and M'[i][2]="1" ("YES" in ST 6110), sorting section 522 sets M'[i][1] to "1" and M'[i][2] to "3" in ST 6120, and moves the step to ST 6150.

By contrast, if it is decided in ST 6110 that the two conditions M'[i][1]="3" and M'[i][2]="1" are not met at the same time ("NO" in ST 6110), sorting section 522 moves the step to ST 6130.

In ST 6130, sorting section 522 decides whether or not M'[i][1]="4" and M'[i][2]="2."

If it is decided in ST 6130 that M'[i][1]="4" and M'[i][2]="2" ("YES" in ST 6130), sorting section 522 sets M'[i][1] to "2" and M'[i][2] to "4" in ST 6140, and moves the step to ST 6150.

By contrast, if it is decided in ST 6130 that the two conditions M'[i][1]="4" and M'[i][2]="2" are not met at the same time ("NO" in ST 6130), sorting section 522 moves the step to ST 6150.

In ST 6150, sorting section 522 increments "i" by one and moves the step to ST 6020.

For example, if sorting section 522 forms M'[6][2]={{2, 0}, {3, 1}, {2, 3}, {1, 0}, {2, 1}, {0, 3}} using M[3][4]={{2, 0, 3, 1}, {2, 3, 1, 0}, {2, 1, 0, 3}}, and further adjusts the order of pairs of two pulses included in M'[6][2] according to the steps shown in FIG. 9, M'[6][2]={{0, 2}, {1, 3}, {2, 3}, {0, 1}, {1, 2}, {3, 0}} is found. Further, sorting section 522 forms M[3][4]={{0, 2, 1, 3}, {2, 3, 0, 1}, {1, 2, 3, 0}} again using M'[6][2]={{0, 2}, {1, 3}, {2, 3}, {0, 1}, {1, 2}, {3, 0}} acquired by adjustment, and outputs it to search section 224.

The effect of adjustment processing in sorting section 522 shown in FIG. 9 will be explained below.

A search of pulses forming a fixed codebook is performed by searching for pulse positions and polarities by which function C in above equation 4 is maximized. Therefore, upon search, a memory (RAM: Random Access Memory) is needed for the matrix HH of the denominator term in equation 4. For example, when the length of an excitation vector is 32, a memory is necessary which supports a half of 32×32 matrix including the diagonal vector. That is, a memory of (32×32/2+16) bytes=528 bytes is needed. Here, a memory is necessary which supports a full matrix (32×32 bytes=1024 bytes) to reduce the amount of calculations required to access a designated index upon calculation, and, consequently, a larger memory is needed.

By contrast with this, like the present invention, by dividing in advance pulses forming a fixed codebook into pairs of the subset to be searched first and the subset to be searched next and by searching for pulses on a per pair basis, only an 8×8 (the square of the number of entries per pair) matrix is required, so that it is possible to save the memory capacity to 8×8×6=384 bytes. In this case, this matrix is not a symmetric matrix, and, consequently, the matrix varies if the order of pulse numbers is reversed. As a result, it is necessary to further prepare an inverse matrix (which doubles the memory capacity), change the access method upon search (which increases the amount of calculations) or prepare a program per pair combination (which increases the memory capacity and the amount of calculations). Therefore, the present embodiment rearranges the order of pulses upon search per pair, and limits the whole search to six pairs. By this means, it is possible to limit the memory capacity required for pulse search to 384 bytes as above, and reduce the amount of calculations.

Thus, according to the present embodiment, upon grouping pulses forming a fixed codebook into pairs, the pulses to be grouped are rearranged in a predetermined order and searched for on a per pair basis, so that it is possible to reduce the memory capacity and the amount of calculations, which are required for a fixed codebook search.

Also, although an example case has been described above with the present embodiment where pairs of pulses to be searched are limited to six patterns of {0, 1}, {1, 2}, {2, 3}, {3, 0}, {0, 2} and {1, 3}, the present invention is not limited to this, and it is equally possible to reverse the order of pulses included in above pairs, which does not change the average performance of pulse search.

Embodiments of the present invention have been described above.

Also, the fixed codebook according to the above embodiments may be referred to as a "noise codebook," "stochastic codebook" or "random codebook."

Also, an adaptive codebook may be referred to as an "adaptive excitation codebook," and a fixed codebook may be referred to as a "fixed excitation codebook."

Also, LSP may be referred to as "LSF (Line Spectral Frequency)," and LSF can be substituted for LSP. Also, although a case is possible where ISP's (Immittance Spectrum Pairs) are encoded as spectral parameters instead of LSP's, in this case, by substituting ISP's for LSP's, it is possible to implement the above embodiments as an ISP encoding apparatus.

Although a case has been described above with the above embodiments as an example where the present invention is implemented with hardware, the present invention can be implemented with software.

Furthermore, each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2007-196782, filed on Jul. 27, 2007, Japanese Patent Application No. 2007-260426, filed on Oct. 3, 2007, and Japanese Patent Application No. 2008-007418, filed on Jan. 16, 2008, including the specifications, drawings and abstracts, are incorporated herein by reference in their entireties.

INDUSTRIAL APPLICABILITY

The speech encoding apparatus and speech encoding method according to the present invention allows speech encoding by a fixed codebook with efficient use of bits, and are applicable to, for example, mobile telephones in a mobile communication system.

The invention claimed is:

1. A speech encoding apparatus comprising:

a calculating section that calculates a correlation value for each candidate pulse position using a target signal and a plurality of pulses forming a fixed codebook, and calculates, on a per pulse basis, a representative scalar value of a pulse using a maximum value of the correlation values calculated for the pulse, wherein each representative scalar value corresponds to each pulse;

a sorting section that sorts the representative scalar values acquired on a per pulse basis, for the plurality of pulses, groups pulses corresponding to the sorted representative scalar values into a plurality of predetermined subsets and determines a first subset to be searched first and a second subset to be searched second among the plurality of subsets; and a search section that searches the fixed codebook using the first subset and the second subset and acquires a code indicating positions and polarities of a plurality of pulses for minimizing coding distortion, wherein the calculating section calculates, as the representative scalar value, the maximum correlation value of each pulse by adding a second highest correlation value multiplied by a predetermined rate to a maximum value of the correlation value on a per pulse basis.

2. The speech encoding apparatus according to claim 1, wherein the sorting section sets a subset including a pulse corresponding to a highest representative scalar value among the representative scalar values acquired on a per pulse basis, as the first subset.

3. The speech encoding apparatus according to claim 1, wherein:

the sorting section groups the pulses corresponding to the sorted representative scalar values into a plurality of combinations of a plurality of predetermined subsets, and determines the first subsets in the plurality of combinations, respectively; and the search section searches the fixed codebook using the first subsets and acquires the code to minimize the coding distortion.

4. The speech encoding apparatus according to claim 1, wherein the sorting section determines the first subset using the representative scalar values corresponding to the grouped pulses.

5. The speech encoding apparatus according to claim 1, wherein the sorting section generates a plurality of combinations of the representative scalar values corresponding to the grouped pulses, and determines the first subset based on a comparison result of the combinations multiplied by a predetermined value.

6. The speech encoding apparatus according to claim 1, wherein the sorting section rearranges the pulses to be grouped into the plurality of subsets in a predetermined order.

7. A speech encoding method comprising the steps of:

calculating a correlation value for each candidate pulse position using a target signal and a plurality of pulses forming a fixed codebook, and calculating, on a per pulse basis, a representative scalar value of a pulse using a maximum value of the correlation values calculated for the pulse, wherein each representative scalar value corresponds to each pulse;

sorting the representative scalar values acquired on a per pulse basis, for the plurality of pulses, grouping pulses corresponding to the sorted representative scalar values into a plurality of predetermined subsets and determining a first subset to be searched first and a second subset to be searched second among the plurality of subsets; and searching the fixed codebook using the first subset and the second subset and generating a code indicating positions and polarities of a plurality of pulses for minimizing coding distortion.

* * * * *